United States Patent [19]

Honda

[11] 4,348,011

[45] Sep. 7, 1982

[54] HOIST WITH IMPROVED OVERLOAD PROTECTION

[75] Inventor: Munenobu Honda, Osaka, Japan

[73] Assignee: Elephant Chain Block Co., Ltd., Osaka, Japan

[21] Appl. No.: 135,235

[22] Filed: Mar. 31, 1980

[30] Foreign Application Priority Data

Apr. 3, 1979 [JP] Japan ..... 54-44956[U]

[51] Int. Cl.[3] ..... B66D 1/14

[52] U.S. Cl. ..... 254/350; 192/8 R; 254/368; 254/380

[58] Field of Search ..... 254/350, 368, 376, 380, 254/903, 351, 375, 378; 192/4 R, 8 R, 8 C, 8 B, 15 R; 64/23.6, 30 R, 30 D, 30 C

[56] References Cited

U.S. PATENT DOCUMENTS

| | | | |
|---|---|---|---|
| 788,606 | 5/1905 | Scott et al. | 254/350 |
| 1,187,669 | 6/1916 | Spaulding | 254/380 |
| 2,690,240 | 9/1954 | Schroeder | 254/368 |
| 2,800,985 | 7/1957 | Ronceray | 192/15 |
| 3,399,867 | 9/1968 | Schroeder | 254/376 |

*Primary Examiner*—Billy S. Taylor

*Attorney, Agent, or Firm*—Stevens, Davis, Miller & Mosher

[57] ABSTRACT

A hoist having an overload protection device is provided with a locking mechanism between a hoist body and a disc hub at a mechanical brake provided at the hoist body, the locking mechanism utilizing forward screwing of a driving member forming part of the mechanical brake to lock rotation of the disc hub during an overload condition.

8 Claims, 7 Drawing Figures

2
1b
1
1a
13
13a
13b
11
6a
9
10
3
3a
4
8
6b
6
7
14
12
51
4b
4a
52
53
5
15
17
16

HOIST WITH IMPROVED OVERLOAD PROTECTION

BACKGROUND AND SUMMARY OF THE INVENTION

This invention relates to a hoist, and more particularly to a hoist in which a hand-driven or motor-driven load sheave moves a chain engageable therewith to lift or lower a load.

Generally, this kind of hoist has a mechanical brake provided at a drive shaft which transmits power to the load sheave from a motor or a hand wheel having a hand chain, and an overload protection device provided on a power transmitting route.

The mechanical brake comprises a disc hub fixed to the drive shaft, an anti-reverse-rotation plate restrained from rotating in the direction of lowering the chain, a driving member screwed with the drive shaft, and friction plates interposed between the disc hub and the anti-reverse-rotation plate and between the anti-reverse-rotation plate and the driving member. The overload protection device is separate from the mechanical brake and is provided on the power transmitting route.

The hoist, for safety, is rated at its maximum load, i.e., the maximum weight of a load which can be handled, so that a worker is always instructed to use the hoist within its normal rating.

However, a worker is not always familiar with the precise weight of a load handled by him. He occasionally handles a load over the normal rating of the hoist, causing the load sheave and chain and a reduction gear train to be overloaded and a very dangerous break down of the hoist. To prevent this, the hoist is always equipped with an overload protection device.

Conventionally, the overload protection device is separate from the components of the hoist and comprises a torque limiter, e.g., a slip gear, so that when the hoist lifts a load over the normal rating, the slip gear slips to check the load lifting. The torque limiter which is separately provided, makes the hoist complex in construction and larger in weight. Furthermore, it is possible that the load, once suspended, will fall due to a slip of the slip gear.

In light of the problems, this invention has been designed. An object of the invention is to provide a hoist which is simple in construction, has only a slight increase in weight, and has an overload protection means which is of high efficiency and which is free from the possibility of a suspended load falling even when an overload condition actuates the protection means.

This invention has been designed to utilize the mechanical brake at the hoist for overload protection. The present invention is characterized in that the drive shaft of the hoist is provided with a spline and a screw thread, the spline supporting a disc hub axially movably, the screw thread screwing with a driving member, the disc hub being disposed opposite to the driving member; an anti-reverse-rotation plate unidirectionally rotatable is interposed between the opposite surfaces of disc hub and driving member through friction plates, and is supported to the disc hub; a pusher biasing the disc hub toward the driving member is provided at one axial side of the disc hub; and between the disc hub and the hoist body is provided a locking mechanism which is actuated by axial movement of the disc hub to thereby stop the rotation thereof.

Forward screwing of the driving member at the mechanical brake is used to move the disc hub axially to thereby actuate the locking mechanism between the disc hub and the hoist body. Hence, the rotation of disc hub, and in turn, of the load sheave, is locked to hold the suspended load in the predetermined position which prevents it from falling when the hoist is overloaded in excess of the normal rating. Consequently, a simple construction addition to the hoist makes it possible to provide overload protection having a high degree of efficiency and safety.

This invention is applicable to both a hand-operated hoist and a motor-driven hoist housing therein an electric motor. In the hand-operated hoist, a hand wheel engaging with a hand chain functions as the driving member, and in the motor-driven hoist, a second gear of a reduction gear train which transmits power from the motor to the load sheave functions as the driving member.

In the hand-operated hoist the locking mechanism is provided between the disc hub and a base plate constituting the hoist body. In the motor-driven hoist the locking mechanism is provided between the disc hub and a stationary member fixed to the base plate.

These and other objects and novel features of the invention will be more apparent from the following description of an embodiment thereof provided in conjunction with the accompanying drawings.

DETAILED DESCRIPTION OF THE INVENTION

Figure 1:
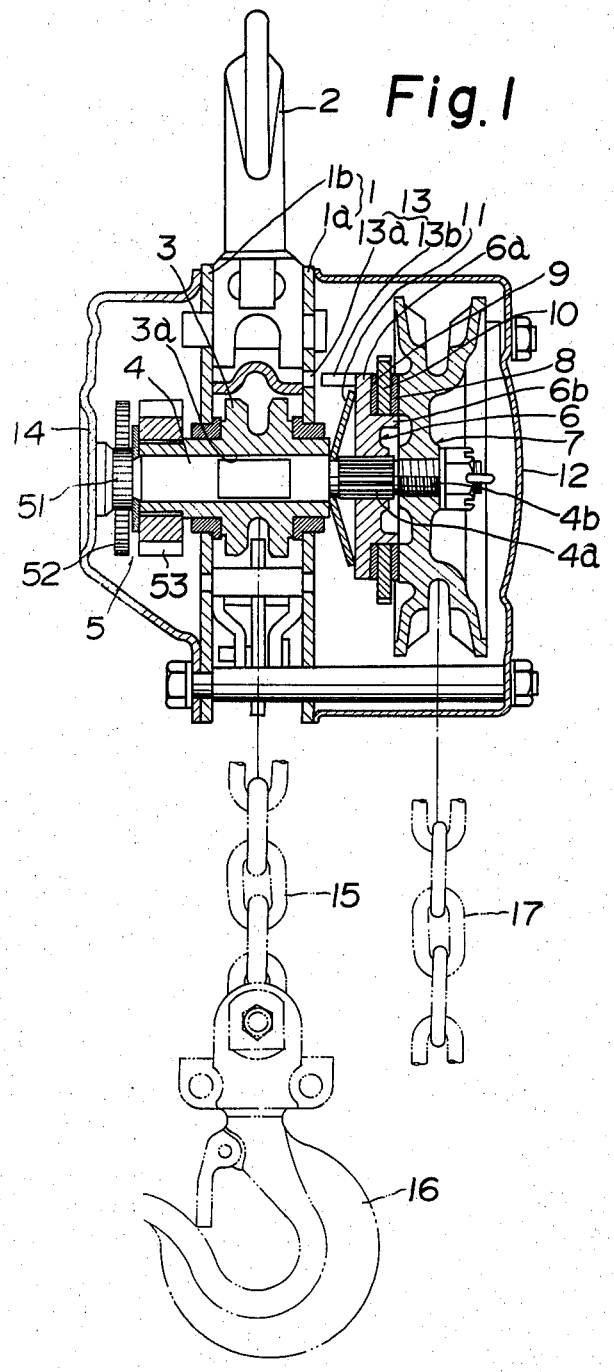
FIG. 1 is a longitudinally sectional view of an embodiment of a hand-operated hoist of the invention.

A hand-operated hoist is shown in FIG. 1, in which reference numeral 1 designates a hoist body comprising a pair of base plates 1*a* and 1*b* opposite each other and spaced apart by a given amount. The base plates 1*a* and 1*b* pivotally support at the upper portions thereof a hook 2 for hanging the hoist body 1 through a pin and rotatably support at the intermediate portions a load sheave 3 engageable with a load chain 15. The load sheave 3 is provided at the center thereof with a shaft hole 3*a* through which a drive shaft 4 is rotatably supported.

The drive shaft 4 constitutes power-actuating means which drives the load sheave 3, and projects at both axial ends outwardly from the load sheave 3. A spline 4*a* and a screw thread 4*b* are provided at the outer periphery of one axial end projection of drive shaft 4, and a first gear 51 of a reduction gear train 5 is provided at the outer periphery of the other axial end projection. A disc hub 6 is supported axially movably to the shaft 4 through a spline connection 4*a*, and a hand wheel 7 constituting the driving member screws with the screw thread 4*b*, the disc hub 6 being opposite to the hand wheel 7. A pair of friction plates 8 and 9 are interposed between the opposite surfaces of a disc 6*a* at the disc hub 6 and of the hand wheel 7. An anti-reverse-rotation plate 10 is sandwiched between the friction plates 8 and 9 and supported onto a trunk 6*b* of disc hub 6 in a relation of being rotatable in the direction of lifting the chain 15 and being restrained from rotating in the direction of lowering the chain 15. A pusher 11 biasing the disc hub 6 toward the hand wheel 7 is mounted on the one axial end projection of disc hub 6 at a side of the base plate 1*a*.

In this construction, the disc hub 6 in spline connection with the drive shaft 4, hand wheel 7 screwable therewith, friction plates 8 and 9, and anti-reverse-rotation plate 10, form a mechanical brake. The drive shaft 4, reduction gear train 5 and mechanical brake, form power-actuating means for driving the load sheave 3.

The pusher 11 is formed mainly of a dish-like shaped leaf spring, has at the center a through bore, is supported at the central portion onto the drive shaft 4 rotatably relative thereto, and contacts at the outer peripheral edge with the disc 6*a*, whereby the elastic force of pusher 11 biases the disc hub 6 against the lateral side of hand wheel 7. Alternatively, the pusher 11 may be formed of a coil spring.

The anti-reverse-rotation plate 10 mainly comprises a ratchet wheel. A fixing pawl (not shown) engageable with or disengageable from the anti-reverse-rotation plate 10, is pivoted to a wheel cover mounted on the base plate 1*a*, and engages with the anti-reverse-rotation plate 10 to thereby prevent rotation thereof in the direction of lowering the load chain 15.

The reduction gear train 5 comprises the first gear 51 provided at the outer periphery of the other axial end projection of shaft 4 (at a side of the base plate 1*b*), a second gear 52 in mesh with the first gear 51 and supported onto an intermediate shaft (not shown) which is rotatably supported between the base plate 1*b* and a gear cover 14 mounted thereon, a third gear (not shown) integral with the second gear 52, and a fourth gear 53 in mesh with the third gear and provided at the outer periphery of one axial end of load sheave 3 projecting outwardly from the base plate 1*b*, so that the driving force from the drive shaft 4 is reduced in speed and then transmitted to the load sheave 3 through the gear train 5 comprising the first gear 51, second gear, third gear and fourth gear 54.

Furthermore, the hoist of the invention is provided with overload protection means to be hereinafter described.

The overload protection means includes a locking mechanism 13 provided between the disc hub 6 and the base plate 1*a*. When the hoist tries to lift a load over the normal rating, the overload protection means actuates the locking mechanism 13 by use of forward screwing of the hand wheel 7 in the mechanical brake to thereby stop the rotation of disc hub 6, and in turn, load sheave 3, and prevent the load from being further lifted and also from falling down.

The locking mechanism 13 comprises a first engaging portion 13*a* and a second engaging portion 13*b* engageable therewith, and is provided between the disc hub 6 and the base plate 1*a* at the hoist body 1, so that the disc hub 6 axially moves to engage the first engaging portion 13*a* with the second engaging portion 13*b* to thereby stop the rotation of disc hub 6. One of the first and second engaging portions 13*a* and 13*b* may be bores and the other, a projection engageable therewith, or both may be projections.

Figure 2:
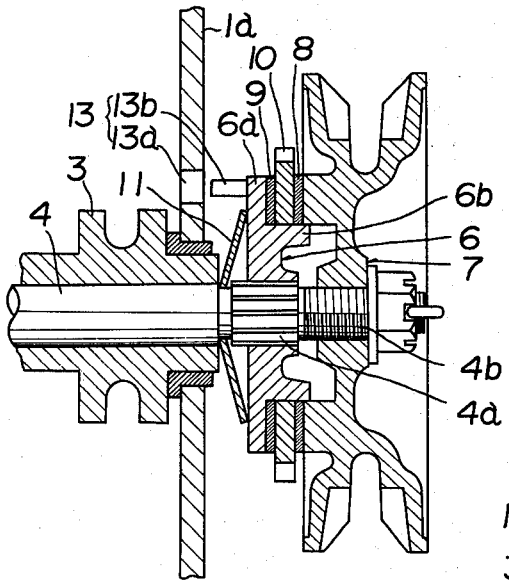
FIG. 2 is a partially enlarged sectional view thereof.
Figure 3:
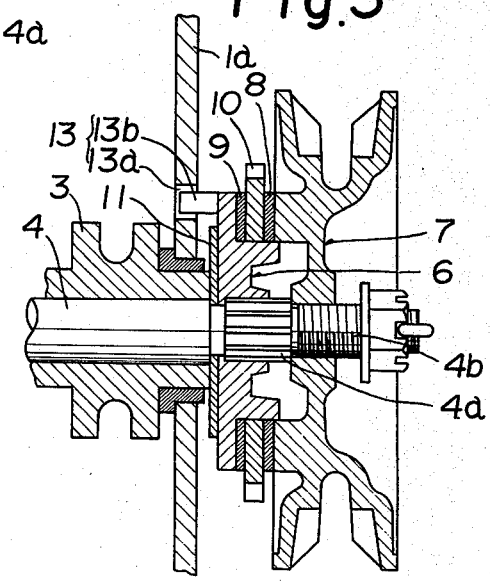
FIG. 3 is a partially enlarged sectional view corresponding to FIG. 2, of the hoist with an actuated locking mechanism caused by lifting a load over the hoist rating.

The locking mechanism shown in FIGS. 1 through 3, has the first engaging portion 13*a* formed of a plurality of bores provided at the base plate 1*a* and the second engaging portion 13*b* formed of one projection provided at the disc 6*a* at the disc hub 6.

Figure 4:
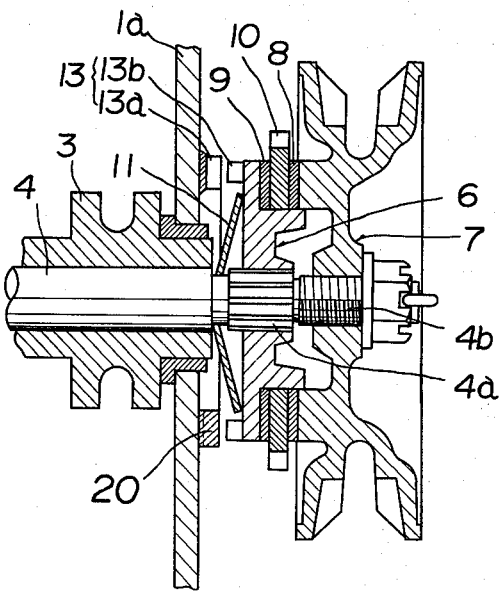
FIG. 4 is a partially enlarged sectional view corresponding to FIG. 2, of a modified embodiment of the invention.

In FIG. 4, the first and second engaging portions 13*a* and 13*b* respectively comprise projections formed like ratchet teeth. Alternatively, such projections may be provided at a ring separate from the base plate 1*a* and disc hub 6, the ring being fixed to the base plate 1*a* or disc hub 6 by fixing means, such as welding. In addition, in FIG. 4, a ring 20 is separate from the base plate 1*a* and welded thereto and carries the projections for the first engaging portion 13*a*. Also, the base plate 1*a* or disc hub 6 may be partially cut and bent in press work to form the projections (not shown).

In addition, in FIG. 1, reference numeral 16 designates a hook for hanging a load, the hook 16 being mounted on the terminal of load chain 15 which is in engagement with the load sheave 3. Reference numeral 17 designates an endless hand chain engageable with the hand wheel 7.

Next, the function of the hoist of the invention will be described.

The hoist constructed as described is operated to lift a load by pulling the hand chain 17 is pulled to normally rotate the hand wheel 7, so that the hand wheel 7 screwably moves toward the disc hub 6 with respect to the drive shaft 4, and axial thrust from the screwing of hand wheel 7 connects, in unity, the friction plates 8 and 9, anti-reverse-rotation plate 10 and disc hub 6, so that the power from the rotating hand wheel 7 is transmitted to the disc hub 6 and rotates the drive shaft 4 together therewith, whereby the drive shaft 4 rotates the load sheave 3 through the reduction gear train 5, thus upwardly winding the load chain 15 carried on the load sheave 3.

At this time, when the load to be lifted is under the normal rating, the pusher 11 biases the disc hub 6 so it does not move axially inwardly, whereby the mechanical brake comprising the disc hub 6, friction plates 8 and 9, anti-reverse-rotation plate 10 and hand wheel 7, operates to prevent lowering of the load chain 15. Hence, the load chain 15 is wound upwardly while being restrained from being lowered.

On the other hand, when lowering the load, the hand chain 17 is pulled to reversely rotate the hand wheel 7, whereby the hand wheel 7 screws backward and away from the disc hub 6. The backward screwing of hand wheel 7 releases the mechanical brake to free the load sheave. Hence, the load sheave 3 is subjected to tension applied to the load chain 15 by the load and reversely rotates to lower the load chain 15 to the extent of the axial movement of the hand wheel 7 which reversely rotates. At the same time, the mechanical brake follows the load sheave 3 and is again actuated upon a stop of the reverse rotation of hand wheel 7. In other words, since the load sheave 3 reversely rotates to allow the drive shaft 4 to reversely rotate, the hand wheel 7 in stationary condition, screwably moves toward the disc hub 6 through the reversely rotated drive shaft 4 to thereby contact with the friction plate 8. As a result, frictional resistance caused by the contacting of the hand wheel 7 with the friction plate 8 and engagement of the fixing pawl with the anti-reverse-rotation plate 10, restrain the load sheave 3 from reversely rotating, and prevents the load from lowering.

Next, description will be provided of what occurs when the hoist tries to lift a load over the normal rating. In this case, torque applied to the disc hub 6 in the direction of reverse rotation thereof through the load sheave 3, reduction gear means 5 and drive shaft 4, is larger than that applied to the hand wheel 7 in the direction of normal rotation thereof, whereby even when the hand wheel 7 tries to normally rotate, the disc hub 6 tends to be stationary or rotate reversely with respect to the hand wheel 7. As a result, the hand wheel 7 slips with respect to the disc hub 6 to cause relative rotation between the hand wheel 7 and the disc hub 6. Upon generation of this slip, the hand wheel 7 screws forward with respect to the drive shaft 4 by an extent corresponding to the slip to thereby compensate for the slip. Hence, the disc hub 6, which is axially movable, is biased axially inwardly against the pusher 11 due to the forward screwing of hand wheel 7, thereby moving axially to an extent corresponding to the slip.

The slip caused by the difference in torque between the disc hub 6 and the hand wheel 7, is repeatedly generated to continue the forward screwing of hand wheel 7 and axially inward movement of disc hub 6. Thus, accumulated axially inward movement of disc hub 6 finally allows the first and second engaging portions 13*a* and 13*b* at the locking mechanism 13 to engage with each other, thereby restraining the disc hub 6 from rotating. As a result, it is impossible to lift a load larger than the overload rating.

Accordingly, the overload protection means ensures that the load chain 15 and reduction gear train 5 are prevented from being broken by the overload and that the load, once lifted, is prevented from falling.

In addition, the hand wheel 7 can reversely rotate to move the disc hub 6 axially outwardly due to the biasing force of pusher 11 to thereby disengage the first engaging portion 13*a* from the second one 13*b*.

Figure 5:
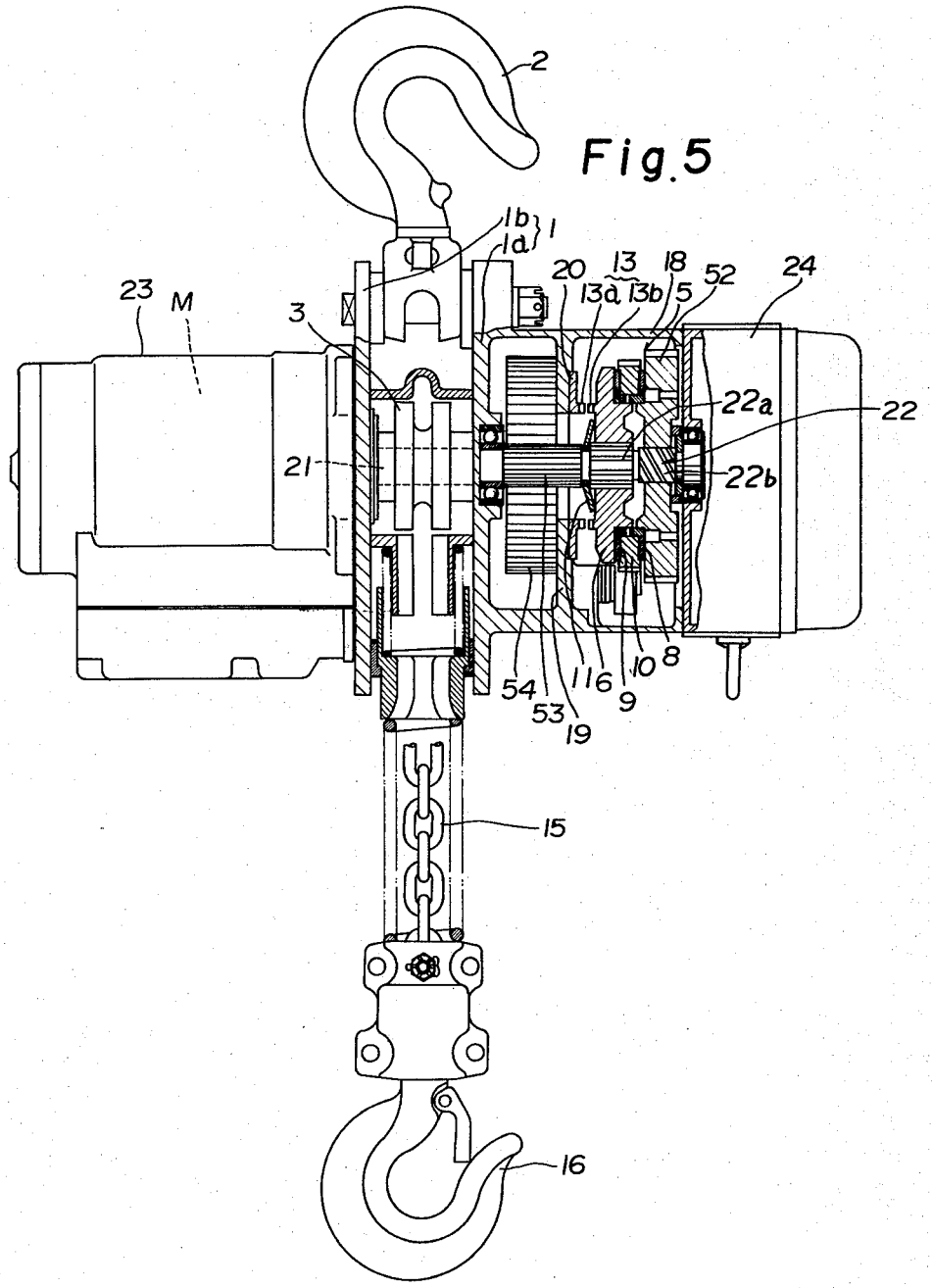
FIG. 5 is a partially cutaway front view of another modified embodiment which is a motor-driven hoist.
Figure 6:
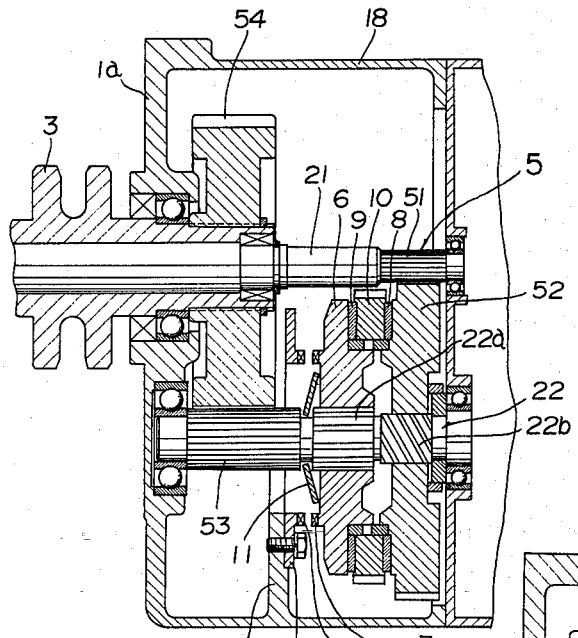
FIG. 6 is an enlarged sectional view of a principal portion of FIG. 5.
Figure 7:
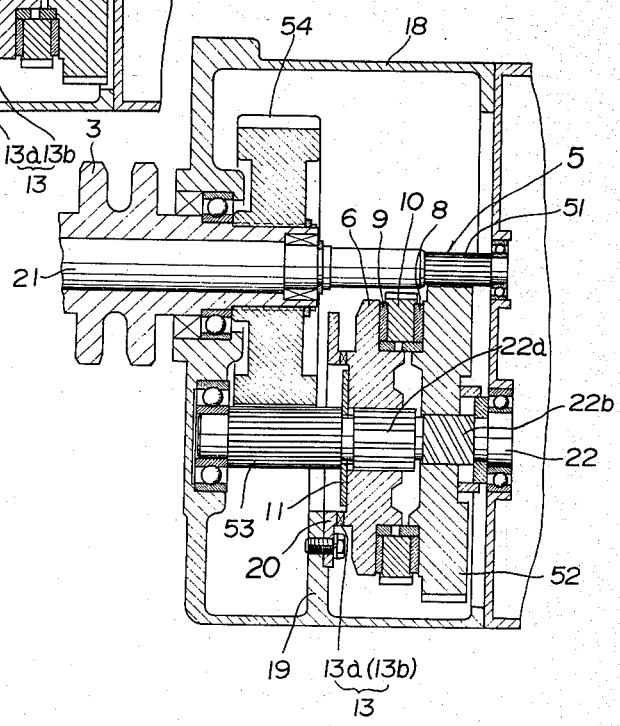
FIG. 7 is an enlarged sectional view corresponding to FIG. 6, of the hoist in operation.

This invention also is applicable to an electric-motor-driven hoist as shown in FIGS. 5 through 7.

The electric-motor-driven hoist is basically the same as the hand-operated hoist, and differs only in that a drive motor M is used in place of the hand wheel 7 and the mechanical brake is incorporated with the intermediate shaft at the reduction gear train 5.

In FIGS. 5 through 7, components of the hoist corresponding to those shown in FIGS. 1 through 4, are represented by the same reference numerals respectively.

In greater detail, the electric-motor-driven hoist is provided with a reduction gear train 5 comprising a first gear 51 provided at the utmost end of a motor shaft 21 which projects through base plates 1*a* and 1*b*, a second gear 52 in mesh with the first gear 51 and carried on one axial end of an intermediate shaft 22 parallel to the motor shaft 21, a third gear 53 provided at the other axial end of the intermediate shaft 22, and a fourth gear 54 in mesh with the third gear 53 and fixed or spline-connected to the one axial end of a load sheave 3; and with a mechanical brake incorporated with intermediate shaft 22 at the reduction gear train 5.

The mechanical brake is the same as in the hand-operated hoist, and differs only in that the second gear 52 substitutes for the hand wheel 7. In addition, the hand-operated hoist has the drive shaft 4 screwing with the hand wheel 7, but in the electric-motor-driven hoist, the intermediate shaft 22 screws with the second gear 52. The intermediate shaft 22 is included into drive shaft in a broad sense, and is included within the meaning of the term drive shaft as described in claims.

The overload protection means, which is an important component of the invention, is assembled into the electric-motor-driven hoist in such a manner that a partition 19 is provided upright at a gear cover 18 covering the reduction gear train 5 and integral with the base plate 19, and between the partition 19 and a disc hub 6 in spline connection with the intermediate shaft 22 is interposed a locking mechanism 13 constituting the overload protection means.

The locking mechanism 13 shown in FIGS. 5 through 7 is similar in construction to that in FIG. 4. Namely, a ring 20 having ratchet teeth like projections is fixed to the partition 19 by a fixing means of bolts. A pusher 11 biasing the disc hub 6 is supported onto the intermediate shaft 22.

Hence, the overload protection means, when the hoist tries to lift a load over the normal rating of the motor M, actuates the locking mechanism 13 by use of forward screwing of the second gear 52, so that the locking mechanism 13 stops the rotation of disc hub 6 and locks the intermediate shaft 22 to stop the rotation of load sheave 3, thereby preventing the load from being further lifted and from falling.

In addition, in FIGS. 5 through 7, reference numeral 22*a* designates a spline provided at the intermediate shaft 22 and reference numeral 22*b* designates a screw thread thereon. Reference numeral 23 designates a motor cover and 24 designates a box housing therein electric accessories.

As clearly understood from the aforesaid description, the hoist of the invention rotates the driving member of a hand wheel or second gear of a motor driven hoist normally or reversely so as to make it possible to usually lift or lower a load. The hoist, while operating with a mechanical brake, allows the driving member to slip with respect to the disc hub when lifting a load over the hoist rating, so that the disc hub axially moves against the biasing force of the pusher to thereby lock the disc hub by means of the locking mechanism. Hence, the hoist of the invention provides an overload protection which prevents the load chain, load sheave and reduction gear train, from being broken and a suspended load from falling.

Furthermore, use of an overload protection mechanism in conjunction with the mechanical brake makes the hoist simple in construction and inexpensive to produce in comparison with the hoist provided with a separately slip mechanism.

As many apparently widely different embodiments of this invention may be made without departing from the spirit and scope thereof, it is to be understood that the invention is not limited to the specific embodiments described but is only limited by the appended claims.

What is claimed is:

1. A hoist comprising: a main body; means for hanging said body; a load sheave supported rotatably to said body; a chain engageable with said load sheave for lifting and lowering a load; power-actuating means for rotating said load sheave, said power-actuating means including a drive shaft, a disc hub spline connected to said drive shaft, a driving member screwably connected with said drive shaft, an anti-reverse-rotation plate supported to said disc hub for preventing said disc hub from rotating in a direction of moving said chain downwardly, and friction plates interposed between opposite surfaces of said disc hub and anti-reverse-rotation plate and between opposite surfaces of said driving member and anti-reverse-rotation plate; and overload protection means including a locking mechanism provided between said disc hub and said body and a biasing means for biasing said disc hub toward said driving member; said driving member screwably moving toward said disc hub to move said disc hub axially of said drive shaft and actuate said locking mechanism when a load applied to said chain exceeds a predetermined value, whereby rotation of said disc hub is locked to halt the lifting of a load by said rotatably driven load sheave.

2. A hoist according to claim 1, wherein said locking mechanism comprises a first engaging portion and a second engaging portion engageable therewith for stopping rotation of said disc hub, said first engaging portion being provided at said hoist body, said second engaging portion being provided at said disc hub.

3. A hoist according to claim 2, wherein one of said first and second engaging portions comprises bores and the other comprises a projection engageable with one of said bores.

4. A hoist according to claim 2, wherein said first and second engaging portions comprise a plurality of projections respectively.

5. A hoist according to claim 4, wherein said projections are formed like ratchet teeth.

6. A hoist according to claim 4, wherein said first engaging portion comprising said projections is integral with a base plate of said hoist body.

7. A hoist according to claim 1, wherein said driving member comprises a hand wheel, said hand wheel carrying on the outer periphery thereof a hand chain having length larger than that of said outer periphery, said hand chain being hand-operated to drive said load sheave.

8. A hoist according to claim 1, further comprising a driving motor for driving said load sheave and a reduction gear train for transmitting the power from said motor to said load sheave, said reduction gear train including a first gear in association with a shaft of said motor, a second gear in mesh with said first gear, a third gear supported coaxially with said second gear, and a fourth gear in mesh with said third gear and in association with said load sheave, said second gear functioning as said driving member; said disc hub, said anti-reverse-rotation plate and said friction plates being interposed between said second gear and said third gear; and a stationary member fixed to a base plate of said main body provided between said disc hub and said third gear; said locking member being provided between said stationary member and said disc hub.

* * * * *